US006880503B2

(12) United States Patent
Rosskamp

(10) Patent No.: US 6,880,503 B2
(45) Date of Patent: Apr. 19, 2005

(54) PORT-CONTROLLED TWO-CYCLE ENGINE HAVING SCAVENGING

(75) Inventor: Heiko Rosskamp, Adelberg (DE)

(73) Assignee: Andreas Stihl AG & Co. KG (DE)

( * ) Notice: Subject to any disclaimer, the term of this patent is extended or adjusted under 35 U.S.C. 154(b) by 0 days.

(21) Appl. No.: 10/444,357

(22) Filed: May 23, 2003

(65) Prior Publication Data

US 2003/0217712 A1 Nov. 27, 2003

(30) Foreign Application Priority Data

May 24, 2002 (DE) ..... 102 23 071

(51) Int. Cl.[7] ..... F02B 33/04
(52) U.S. Cl. ..... 123/73 PP
(58) Field of Search ..... 123/73 PP, 73 A, 123/65 R, 73 R

(56) References Cited

U.S. PATENT DOCUMENTS 4,210,108 A 7/1980 Hooper
5,379,732 A 1/1995 Mavinahally et al.
6,298,811 B1 * 10/2001 Sawada et al. ..... 129/73 A
6,491,004 B1 * 12/2002 Rosskamp et al. ..... 123/73 PP
6,644,251 B1 * 11/2003 Klaric ..... 123/73 A
2001/0018899 A1 9/2001 Rosskamp et al.

FOREIGN PATENT DOCUMENTS

| | | | |
|---|---|---|---|
| CA | 2087207 | 7/1994 | |
| EP | 0971110 | 1/2000 | |
| FR | 2 754 563 | 4/1998 | |
| WO | WO 200043650 A1 * | 7/2000 | ..... F02B/25/14 |

* cited by examiner

*Primary Examiner*—Tony M. Argenbright
*Assistant Examiner*—Hyder Ali
(74) *Attorney, Agent, or Firm*—Robert W. Becker & Associates; Robert W. Becker

(57) ABSTRACT

A two-cycle engine includes a reciprocating piston reciprocable in a combustion chamber and interconnected with a crankshaft in a crankcase. A transfer channel selectively fluidly connects the crankcase with the combustion chamber so a fuel/air mixture in the crankcase enters the combustion chamber for discharging exhaust gas from the combustion chamber. The transfer channel has a constructive volume between an inlet window into the combustion chamber and an opening window into the crankcase such that the volume of essentially fuel-free air that is drawn into the transfer channel during an intake stroke is no more than 75% of the constructive volume of the transfer channel.

12 Claims, 2 Drawing Sheets

PORT-CONTROLLED TWO-CYCLE ENGINE HAVING SCAVENGING

BACKGROUND OF THE INVENTION

The present invention relates to a two-cycle engine, especially for a portable, manually-guided implement such as a power chain saw, a cut-off machine, or the like.

WO 99/18338 (EP 0 971 110 A1) discloses a two-cycle engine to which combustion air is supplied via an air channel. The air channel opens via a diaphragm valve into a transfer channel. To achieve low exhaust gas values, the ratio of the previously stored air to the fuel/air mixture supplied to the crankcase is 0.7 to 1.4. The diaphragm valve opens and closes due to different pressure levels in the air channel and crankcase. The air quantity supplied to the transfer channels is thus dependent upon the existing pressure conditions. Since these pressure conditions vary with respect to the speed, too much air is supplied via the transfer channels to such an internal combustion engine at low speeds. The fuel/air mixture supply to the combustion chamber therefore becomes lean, resulting in a poor operating characteristic in the low speed range.

It is therefore an object of the present invention to provide a two-cycle engine of the aforementioned general type according to which, at advantageous operating characteristics, good exhaust gas values are achieved in all speed ranges.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
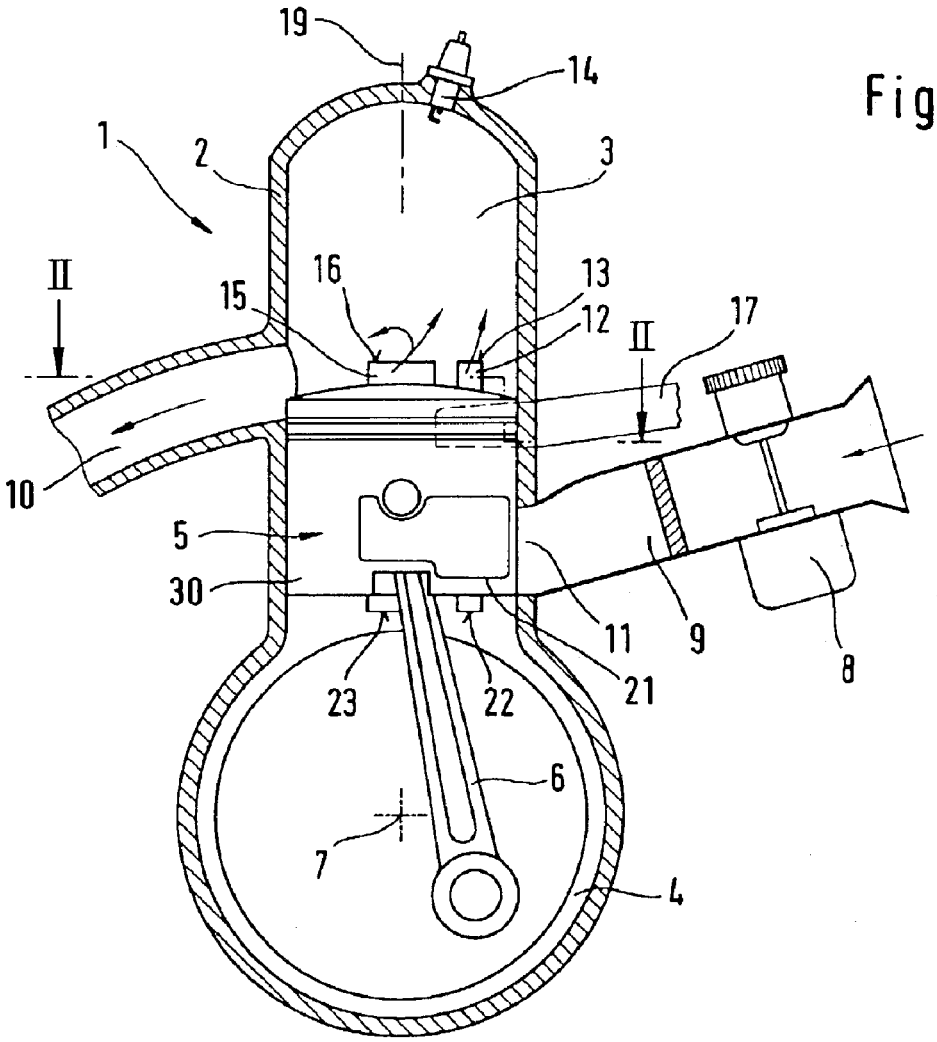
FIG. 1 is a longitudinal cross-sectional view through a two-cycle engine.

The two-cycle engine of the present invention comprises a cylinder in which is formed a combustion chamber that is delimited by a reciprocating piston that, via a connecting rod, drives a crankshaft that is rotatably mounted in a crankcase, wherein an inlet is provided for supplying a fuel/air mixture to the crankcase, wherein an outlet is provided for discharging exhaust gas from the combustion chamber, wherein at least one transfer channel is provided that, in prescribed positions of the piston, fluidically connects the crankcase with the combustion chamber, wherein the transfer channel opens via an inlet window into the combustion chamber, and via an opening window into the crankcase, wherein the transfer channel, in a region along the length thereof, has a closed configuration relative to the cylinder, wherein an air channel is provided for conveying essentially fuel-free air, wherein the air channel is fluidically connected, in a port-controlled manner, with at least one transfer channel, and wherein at a rated speed a quantity of air flowing from the air channel into the transfer channel during a piston stroke has a volume that is at least 75% of the volume of the transfer channel between the inlet window and the opening window.

Due to the port control of the fluidic connection of air channel and transfer channel, the channels are interconnected independently of the pressure conditions and only as a function of the control time. For a favorable combustion, it is provided that the air quantity flowing into the transfer channel, at the rated speed, has a volume that corresponds to at least 75% of the volume of the transfer channel between the inlet window and opening window. This quantity of previously stored air leads to a good separation of exhaust gases and subsequently flowing-in fuel/air mixture. At the same time, too lean of a fuel/air mixture flowing into the combustion chamber is avoided.

The fraction of the mass flow supplied to the transfer channel via the air channel during a piston stroke is expediently 0 to 80% of the mass flow supplied to the two-cycle engine during the piston stroke. In particular, the fraction is less than 50%. The percentage of the mass flow supplied to the transfer channel via the air channel during a piston stroke, to the total mass flow supplied to the two-cycle engine during the piston stroke, is advantageously approximately constant over the entire operating range of the two-cycle engine. Since the angle cross-section during port control of the connection of transfer channel and air channel decreases only slightly relative to the speed and approximately constantly, it is possible to advantageously realize this by means of the port control. In this connection, the angle cross section designates the. integral of the progress of the surface area of the narrowest cross-section of the connection of air channel versus the crankshaft angle, whereby integration occurs over one rotation of the crankshaft.

The fluidic connection of air channel and transfer channel in particular permits in principle a flow from air channel into the transfer channel, and a flow in the opposite direction. Flow is permitted depending on the dynamic conditions of the traveling air mass flow according to the transient pressure situation. In prescribed positions of the piston, air channel and transfer channel are expediently fluidically connected via a piston window. The port control can be realized in a straightforward manner via a piston window. In prescribed positions of the piston, two transfer channels that are disposed symmetrically relative to the central plane are advantageously connected with an air channel. In particular, four transfer channels are disposed symmetrically relative to the central plane. In prescribed positions of the piston, four transfer channels are expediently connected with an air channel. As a result, it is possible to realize a good separation of exhaust gas and subsequently flowing-in fuel/air mixture.

Further specific features of the present invention will be described in detail subsequently.

DESCRIPTION OF PREFERRED EMBODIMENTS

Figure 2:
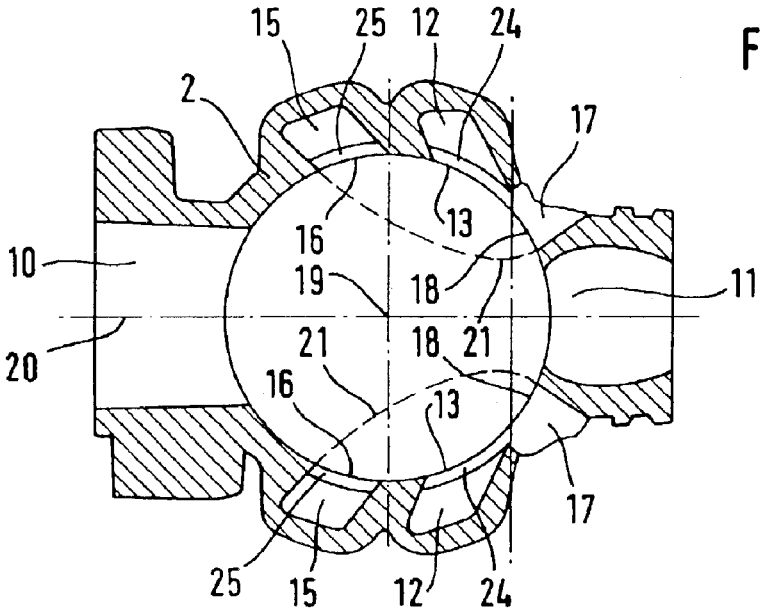
FIG. 2 is a cross-sectional view taken along the line II—II in FIG. 1.

Referring now to the drawings in detail, the two-cycle engine 1 schematically illustrated in FIG. 1 has a cylinder 2 in which is formed a combustion chamber 3. The combustion chamber 3 is delimited by a reciprocating piston 5 that moves between an upper dead center position and a lower dead center position. By means of a connecting rod 6, the piston 5 drives a crankshaft 7 that is rotatably mounted in the crankcase 4. By means of the intake channel 9, fuel/air mixture that is prepared in the carburetor 8 is supplied to the crankcase 4 via the inlet 11. In prescribed positions of the piston, such as in the piston position illustrated in FIG. 1, the crankcase 4 and the combustion chamber 3 are fluidically connected with one another via four transfer channels 12, 15, two of which are illustrated in FIG. 1. The transfer channel 15 that is disposed close to the outlet 10 opens via an inlet window 16 into the combustion chamber 3, and via an opening window 23 into the crankcase 4. The transfer channel 12 that is disposed remote from the outlet 10 opens via an inlet window 13 into the combustion chamber 3 and via an opening window 22 into the crankcase 4. In the region of the inlet windows 13, 16, an air channel 17 opens into the cylinder 2 via an air channel window 18, which is illustrated in FIG. 2. Formed in the piston skirt 30 of the piston 5 is a piston window 21 which, as indicated in the cross-sectional view of FIG. 2, fluidically connects the air channel 17 with the inlet windows 13, 16 of the transfer channels 12, 15 in prescribed positions of the piston. The air channel window 18 is expediently offset relative to the inlet windows 13, 16 in a direction toward the crankcase 4.

During the upward stroke of the piston 5 in a direction toward the combustion chamber 3, fuel/air mixture is drawn into the crankcase 4 via the inlet 11. During the subsequent downward stroke, the fuel/air mixture is compressed in the crankcase 4. While the air channel 17 is fluidically connected via the piston window 21 with the transfer channels 12 and 15, largely fuel-free air flows into the transfer channels 12 and 15 via the air channel and the piston window 21. The largely fuel-free air is stored ahead of the fuel/air mixture from the crankcase 4. During the subsequent downward stroke of the piston 5, the air previously stored in the transfer channels 12 and 15, and subsequent thereto the fuel/air mixture, flows out of the crankcase 4 into the combustion chamber 3 and displaces the exhaust gases from the combustion chamber 3 through the outlet 10, which in particular is disposed approximately across from the inlet 11. During the subsequent upward stroke of the piston 5, the fuel/air mixture in the combustion chamber 3 is compressed, and in the region of the upper dead center position of the piston 5 is ignited by the spark plug 14. In the downward stroke, the exhaust gases are displaced toward the outlet 10 by the in-flowing air and the fuel/air mixture.

As illustrated in the cross-sectional view of FIG. 2, two transfer channels 12 that are remote from the outlet 10, and two transfer channels 15 that are disposed close to the outlet, are disposed symmetrically relative to the central plane 20, which approximately centrally divides the inlet 10 and outlet 11, and includes the longitudinal central axis 19 of the cylinder 2. In the region of their longitudinal extension parallel to the central axis 19 of the cylinder 2, the transfer channels 12, 15 are separated by a wall 24 or 25 from the cylinder 2. The walls 24, 25 extend between the inlet windows 13, 16 and the opening windows 22, 23. In prescribed positions of the piston 5, the inlet windows 13 and 16 of the transfer channels 12 and 15 are fluidically connected with the air channel 17 via the piston window 21, which is indicated by dashed lines in FIG. 2; the air channel 17 is divided into two branches that are disposed symmetrically relative to the central plane 20. In this connection, the air channel 17 opens via a respective air channel window 18 into the cylinder 2.

Figure 3:
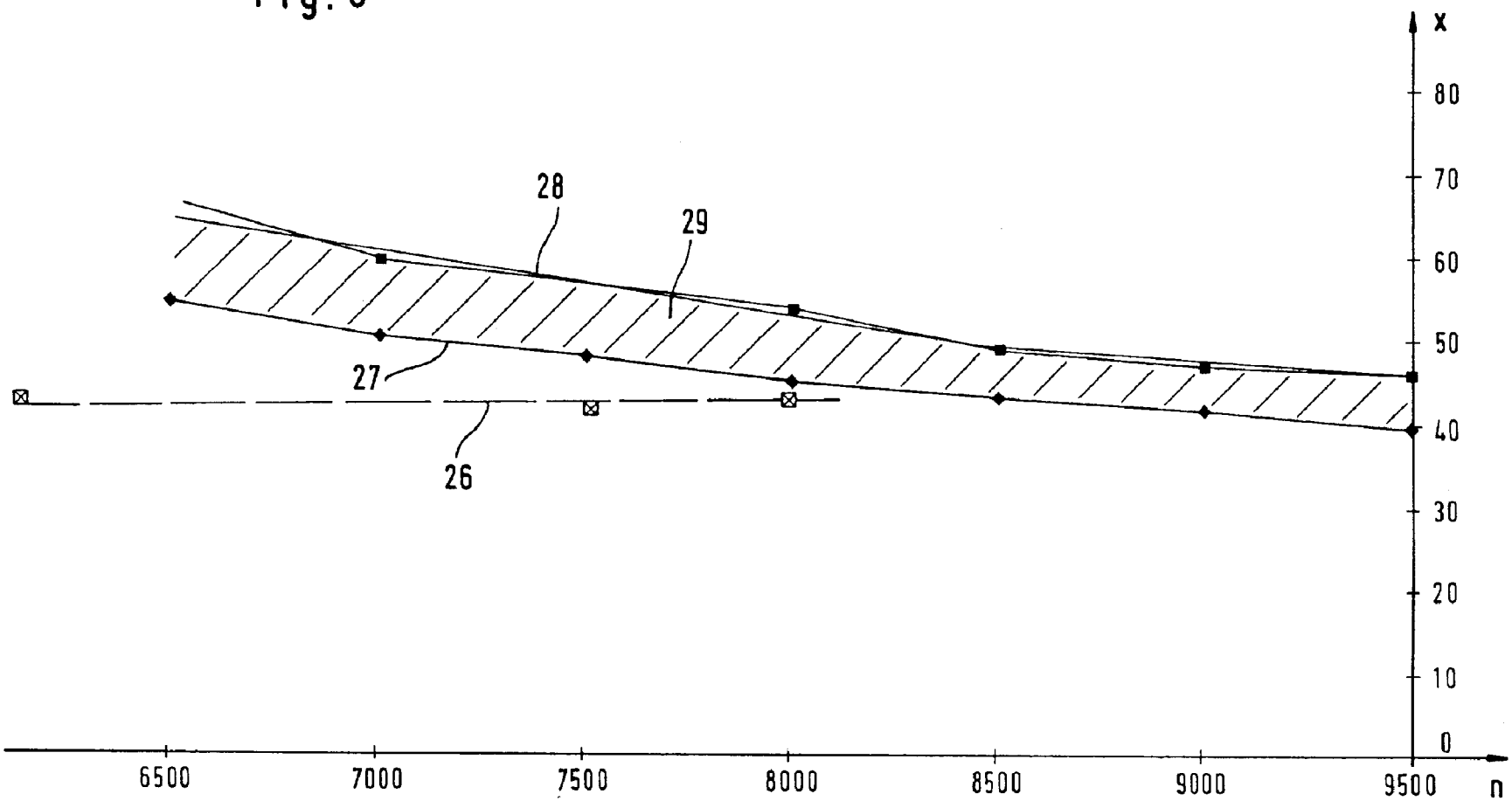
FIG. 3 is a graph that plots the fraction of the mass flow supplied to the transfer channel versus the speed.

In FIG. 3, the fraction or percentage x of the mass flow supplied to the transfer channels 12, 15 during a piston stroke via the air channel 17 is plotted versus the engine speed n. The fraction x is indicated in percentage, and the speed n is indicated in revolutions per minute. The lines 27 and 28 designate limiting curves of the distribution of the fraction x during the connection of air channel and transfer channels via a diaphragm valve. When using a diaphragm valve, the fraction x plotted versus the speed n is generally disposed in the region 29 that is disposed between the limiting curves 27 and 28 and is illustrated in cross-hatching. As illustrated in FIG. 3, as the speed increases, the fraction x decreases. At the rated speed N of about 9000 rpm, the fraction x is approximately between 40 and 50%. With this, there is achieved a favorable ratio of the previously stored quantity of air to the fuel/air mixture that is supplied to the crankcase. At lower speeds, however, the fraction x increases. As a result, at lower speeds the mixture becomes much leaner. The line 26 represents the curve of the fraction x plotted versus the speed with port-control of the connection of air channel 17 and transfer channels 12, 15. The fraction x is approximately constant over the entire operating range of the two-cycle engine 1. In the illustrated embodiment, the fraction x is between 40 and 45%. This results in good exhaust gas values at high speeds. At low speeds, too lean of a mixture is avoided.

The quantity of air that during a piston stroke flows into the transfer channel 12, 15 at the rated speed N expediently has a volume that corresponds at least to 75% of the volume of the transfer channel 12, 15 between the inlet windows 13, 16 and the opening windows 22, 23. At low previously stored volumes, an adequate separation of exhaust gases and subsequently flowing-in fuel/air mixture cannot be ensured. The fraction x of the mass flow that during a piston stroke is supplied to the transfer channel 12, 15 via the air channel 17 is expediently 0 to 80% of the mass flow that is supplied to the two-cycle engine 1 during the piston stroke. Favorable exhaust gas values and good true-running characteristics of the engine in the entire speed range result in particular at a fraction x of less than 50%.

Due to the port control of the connection of air channel and the transfer channels, the angle cross-section is independent of resonance influences in the intake channel. The angle cross-section thus decreases only slightly and in a constant manner versus the speed. In particular, the fraction x versus the speed does not decrease with port control, but rather is largely constant. In contrast to the diaphragm valve, the piston window can in principle have flow therethrough in both directions, so that pressure differences during the connection of air channel and transfer channel can be compensated for in both directions.

It can be expedient for the air channel to open out only into the transfer channels that are close to the outlet. It can also be expedient to have the connection for the air channel with the two transfer channels that are remote from the outlet. In particular, the air channel is connected via the piston windows with all four symmetrically disposed transfer channels. The connection of air channels and transfer channels need not be effected via a piston window, but rather can, for example, also be port controlled by the crank web.

The specification incorporates by reference the disclosure of German priority document DE 102 23 071.4 filed May 24, 2002.

The present invention is, of course, in no way restricted to the specific disclosure of the specification and drawings, but also encompasses any modifications within the scope of the appended claims.

What is claimed is:

1. A two-cycle engine, comprising:

a cylinder;

a combustion chamber formed in said cylinder;

a reciprocating piston reciprocable in said cylinder;

a connecting rod interconnecting said reciprocating piston and a crankshaft that is rotatably mounted in a crankcase, said crankcase being supplied with a fuel/air mixture that enters said crankcase via an inlet;

an outlet in said combustion chamber for discharging exhaust gas from said combustion chamber;

at least one transfer channel operable, in prescribed positions of said piston, to fluidly connect said crankcase with said combustion chamber;

an inlet window formed in said cylinder via which said at least one transfer channel opens into said combustion chamber;

an opening window formed in said cylinder via which said at least one transfer channel is communicated with said crankcase, said at least one transfer channel extending from said inlet window opening into said combustion chamber to said opening window opening into said crankcase;

an air channel fluidly connectable with said inlet window of said at least one transfer channel for the flow of essentially fuel-free air into said at least one transfer channel, said air channel having an air channel window at one end thereof opening into said combustion chamber; and a piston window in said reciprocating piston operable, in prescribed positions of said piston, to fluidly connect said air channel with said at least one transfer channel, said at least one transfer channel having a constructive volume as measured along the extent of said at least one transfer channel between said inlet window that opens into said combustion chamber and said opening window that opens into said crankcase and said constructive volume of said at least one transfer channel being such that, at a rated speed, the volume of essentially fuel-free air that is introduced into said at least one transfer channel during an intake stroke ranges from at least 75% up to no more than 100% of the constructive volume of said at least one transfer channel.

2. A two-cycle engine according to claim 1, wherein a fraction of a mass flow supplied to said at least one transfer channel via said air channel during a piston stroke is 0 to 80% of a mass flow supplied to said two-cycle engine during said piston stroke.

3. A two-cycle engine according to claim 2, wherein said fraction of said mass flow supplied to said at least one transfer channel via said air channel during said piston stroke is less than 50% of said mass flow supplied to said two-cycle engine during said piston stroke.

4. A two-cycle engine according to claim 2, wherein said fraction of said mass flow supplied to said at least one transfer channel via said air channel during a piston stroke is approximately constant relative to the entire mass flow supplied to said two-cycle engine during said piston stroke over the entire operating range of said engine.

5. A two-cycle engine according to claim 1, wherein said fluidic connection of said air channel and said at least one transfer channel permits a flow from said air channel into said transfer channel, and a flow in an opposite direction.

6. A two-cycle engine according to claim 1, wherein said air channel and said at least one transfer channel are fluidically connected in prescribed positions of said piston via a piston window.

7. A two-cycle engine according to claim 1, wherein in said prescribed positions of said piston, two transfer channels are connected with said air channel, and wherein said two transfer channels are symmetrically disposed relative to a central plane that approximately centrally divides said inlet and said outlet.

8. A two-cycle engine according to claim 1, wherein four transfer channels are disposed symmetrically relative to a central plane that approximately centrally divides said inlet and said outlet.

9. A two-cycle engine according to claim 8, wherein in said prescribed positions of said piston, four transfer channels are connected to said air channel.

10. A two-cycle engine according to claim 1, wherein said piston reciprocably moves between an upper dead center position and a lower dead center position with said piston window being formed in said piston such that said piston window communicates said air channel with said at least one transfer channel in said upper dead center position of said piston and said piston window does not communicate said air channel with said at least one transfer channel in said lower dead center position and, during each cycle of reciprocal movement of said piston, while said piston window communicates said air channel with said at least one transfer channel, the essentially fuel-free air flows into said at least one transfer channel to be temporarily stored therein and, during each downward stroke of said piston from said upper dead center position toward said lower dead center position, the essentially fuel-free air temporarily stored in said at least one transfer channel flows into said combustion chamber followed thereafter by a fuel/air mixture from said crankcase also supplied through said at least one transfer channel, whereby the essentially fuel-free air that has been introduced via said piston window into said at least one transfer channel for temporary storage therein occupies, in said at least one transfer channel, at least the frontmost portion thereof that terminates at said inlet window and, accordingly, during each downward stroke of said piston, the essentially fuel-free air temporarily stored in said at least one transfer channel always precedes the fuel/air mixture into said combustion chamber.

11. A two-cycle engine according to claim 10, wherein said inlet window of said at least one transfer channel and said air channel window are at a spacing from one another along said combustion chamber such that fluid communication between said inlet window of said at least one transfer channel and said air channel window is blocked by said piston in the positions of said piston during which said piston window does not communicate said inlet window of said at least one transfer channel and said air channel window.

12. A two-cycle engine, comprising: a cylinder in which is formed a combustion chamber that is delimited by a reciprocating piston that, via a connecting rod, drives a crankshaft that is rotatably mounted in a crankcase, wherein an inlet is provided for supplying a fuel/air mixture to said crankcase, wherein an outlet is provided for discharging exhaust gas from said combustion chamber, wherein at least one transfer channel is provided that, in prescribed positions of said piston, fluidically connects said crankcase with said combustion chamber, wherein said at least one transfer channel opens via an inlet window into said combustion chamber, and via an opening window into said crankcase, wherein said at least one transfer channel in a region along a length thereof, has a closed configuration relative to said cylinder wherein an air channel is provided for conveying essentially fuel-free air, wherein said air channel is fluidically connected, in a port-controlled manner, with at least one of said at least one transfer channel and wherein at a rated speed a quantity of air flowing from said air channel into said at least one transfer channel during a piston stroke has a volume that is at least 75% of a volume of said at least one transfer channel between said inlet window and said opening window, a fraction of a mass flow supplied to said at least one transfer channel via said air channel during a piston stroke is 0 to 80% of a mass flow supplied to said two-cycle engine during said piston stroke, and said fraction of said mass flow supplied to said at least one transfer channel via said air channel during a piston stroke is approximately constant relative to the entire mass flow supplied to said two-cycle engine during said piston stroke over the entire operating range of said engine.

* * * * *